US008671840B2

(12) United States Patent
Scheid et al.

(10) Patent No.: US 8,671,840 B2
(45) Date of Patent: Mar. 18, 2014

(54) FLEXIBLE FRAGMENTATION SLEEVE

(75) Inventors: Eric Scheid, Bloomington, IN (US); Colt Miller, Bloomington, IN (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 310 days.

(21) Appl. No.: 13/016,925

(22) Filed: Jan. 28, 2011

(65) Prior Publication Data

US 2012/0192753 A1 Aug. 2, 2012

(51) Int. Cl.
*F42B 12/22* (2006.01)
*F42B 12/32* (2006.01)

(52) U.S. Cl.
USPC ..... 102/495; 86/1.1

(58) Field of Classification Search
USPC ..... 102/495; 86/1.1
See application file for complete search history.

(56) References Cited

U.S. PATENT DOCUMENTS

| | | | | | |
|---|---|---|---|---|---|
| 3,645,205 | A * | 2/1972 | Dowling | 102/318 |
| 3,799,054 | A | 3/1974 | LaRocca | |
| 3,977,327 | A | 8/1976 | Brumfield et al. | |
| 4,106,410 | A | 8/1978 | Borcher et al. | |
| 4,129,061 | A * | 12/1978 | Bedall et al. | 86/20.12 |
| 4,205,611 | A * | 6/1980 | Slawinski | 102/324 |
| 4,351,240 | A * | 9/1982 | McCubbin et al. | 102/364 |
| 4,369,711 | A * | 1/1983 | Leader | 102/324 |
| 4,493,264 | A | 1/1985 | Jameson | |
| 4,505,201 | A * | 3/1985 | Abele | 102/324 |
| 4,648,323 | A | 3/1987 | Lawther | |
| 4,817,532 | A | 4/1989 | Assmann | |
| 4,899,661 | A | 2/1990 | Kaelin | |
| 4,982,668 | A | 1/1991 | Bender et al. | |
| 5,113,763 | A * | 5/1992 | Schoeyer et al. | 102/202 |
| 5,313,890 | A | 5/1994 | Cuadros | |
| 6,668,727 | B1 | 12/2003 | Kim et al. | |
| 6,857,372 | B2 | 2/2005 | Renaud-Bezot et al. | |
| 7,472,652 | B1 | 1/2009 | Scheid | |
| 8,136,437 | B2 * | 3/2012 | Van Stratum et al. | 86/1.1 |
| 8,286,558 | B2 * | 10/2012 | Marx | 102/527 |
| 8,365,670 | B2 * | 2/2013 | Abramov | 102/495 |
| 2011/0100245 | A1 * | 5/2011 | Williams et al. | 102/364 |
| 2011/0232466 | A1 * | 9/2011 | Stratum et al. | 86/1.1 |
| 2012/0192753 | A1 * | 8/2012 | Scheid et al. | 102/495 |

* cited by examiner

*Primary Examiner* — Michelle Clement
(74) *Attorney, Agent, or Firm* — Christopher A. Monsey

(57) ABSTRACT

A flexible fragmentation sleeve for use with a non-fragmenting explosive device is provided. The flexible fragmentation sleeve comprises a flexible cylindrical wall extending between opposing first and second ends along a longitudinal axis. The cylindrical wall includes an inner liner and an outer liner concentric to the inner liner. A first set of coupling elements extend parallel to the longitudinal axis of the cylindrical wall, and couple the inner liner with the outer liner. A second set of coupling elements extend circumferentially along the cylindrical wall. The second set of coupling elements is substantially perpendicular to the first set of coupling elements, and couple the inner liner with the outer liner. A plurality of pockets is defined intermediate the inner liner and the outer liner, and intermediate the first set of coupling elements and the second set of coupling elements. The flexible fragmentation sleeve of the illustrative embodiment further includes a plurality of fragmentation members. At least one fragmentation member is illustratively received within each pocket.

9 Claims, 12 Drawing Sheets

FLEXIBLE FRAGMENTATION SLEEVE

STATEMENT REGARDING FEDERALLY SPONSORED RESEARCH OR DEVELOPMENT

The invention described herein was made in the performance of official duties by employees of the Department of the Navy and may be manufactured, used, licensed by or for the United States Government for any governmental purpose without payment of any royalties thereon.

BACKGROUND AND SUMMARY OF THE DISCLOSURE

The present invention relates generally to fragmentation sleeves and, more particularly, to field-installed flexible fragmentation sleeves. Illustratively, a removable fragmentation sleeve for use with a hand deployable explosive device is disclosed. The fragmentation sleeve may be used with an offensive hand grenade or concussion grenade, but is not limited thereto.

Hand deployable explosive devices may be fragmenting or non-fragmenting. Upon detonation, fragmenting explosive devices, such as fragmentation grenades, are configured to propel a plurality of fragmentation members toward a target. While non-fragmenting explosive devices, such as concussion grenades, are not configured to produce fragmentation members (e.g., flechettes, shrapnel) upon detonation, these explosive devices may produce greater shock waves than fragmenting explosive devices. An explosive device capable of producing enhanced shock waves (as with concussion grenades) selectively with fragmentation members (as with fragmentation grenades) may increase versatility in the field.

The flexible fragmentation sleeve of the present disclosure is configured to be easily stowed and quickly assembled in the field. The flexible fragmentation sleeve increases versatility in field applications. More particularly, a removable, flexible fragmentation sleeve provides the option to add fragmentation members to a non-fragmenting explosive device. As such, enhanced shock waves of the non-fragmenting explosive device may be combined with the fragmentation members of a fragmenting explosive device. Furthermore, a flexible fragmentation sleeve is lightweight, stowable, and easy to transport.

According to an illustrative embodiment of the present disclosure, a flexible fragmentation sleeve is used with a non-fragmenting explosive device. The flexible fragmentation sleeve comprises a flexible cylindrical wall extending between opposing first and second ends along a longitudinal axis. The cylindrical wall includes an inner liner and an outer liner concentric to the inner liner. A first set of coupling elements extend parallel to the longitudinal axis of the cylindrical wall, and couple the inner liner with the outer liner. A second set of coupling elements extend circumferentially along the cylindrical wall. The second set of coupling elements is substantially perpendicular to the first set of coupling elements, and couple the inner liner with the outer liner. A plurality of pockets is defined intermediate the inner liner and the outer liner, and intermediate the first set of coupling elements and the second set of coupling elements. The flexible fragmentation sleeve of the illustrative embodiment further includes a plurality of fragmentation members. At least one fragmentation member is illustratively received within each pocket.

A further illustrative embodiment includes a hand deployable flexible fragmentation sleeve for use with a non-fragmenting explosive device. The flexible fragmentation sleeve illustratively includes a flexible first liner configured to convert from a storage mode to an operating mode. The flexible first liner is folded onto itself in the storage mode, the flexible first liner defines a cylindrical wall forming a receiving chamber for an explosive device in the operating mode. The flexible fragmentation sleeve may further include a plurality of fragmentation members supported by the flexible liner.

An illustrative method of using a hand deployable flexible fragmentation sleeve with a non-fragmenting explosive device is also disclosed. The method illustratively includes the steps of providing a fragmentation sleeve in a storage mode, the sleeve including a folded flexible side wall in the storage mode, and extending the flexible side wall of the fragmentation sleeve to increase the volume of a receiving chamber, thereby defining an operating mode. The illustrative method further includes the step of slidably receiving a hand held explosive device within the receiving chamber.

An illustrative method of making a hand deployable flexible fragmentation sleeve for use with a non-fragmenting explosive device is also disclosed. The method comprises the steps of providing a first liner and supporting a plurality of fragmentation members on an inner surface of the first liner. The fragmentation members may be placed in spaced relation to each adjacent fragmentation member. The method may further include the step of placing a second liner over the first liner, wherein the inner surface of the first liner faces an inner surface of the second liner. The plurality of fragmentation members are illustratively positioned intermediate the inner surface of the first liner and the inner surface of the second liner. The method may also include the step of providing a plurality of first coupling elements to secure the first liner to the second liner. Each of the first coupling elements may be spaced apart and extend parallel to each adjacent first coupling element. The method may also include the step of providing a plurality of second coupling elements to secure the first liner to the second liner. Each of the second coupling elements may be spaced apart and extends parallel to each adjacent second coupling element. The second coupling elements may extend perpendicular to the first coupling elements, wherein a plurality of pockets may be defined by the intersecting first coupling elements and second coupling elements. Each pocket illustratively receives at least one of the fragmentation members.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the intended advantages of this invention will become more readily appreciated as the same becomes better understood by reference to the following detailed description when taken in conjunction with the accompanying drawings.

Figure 1:
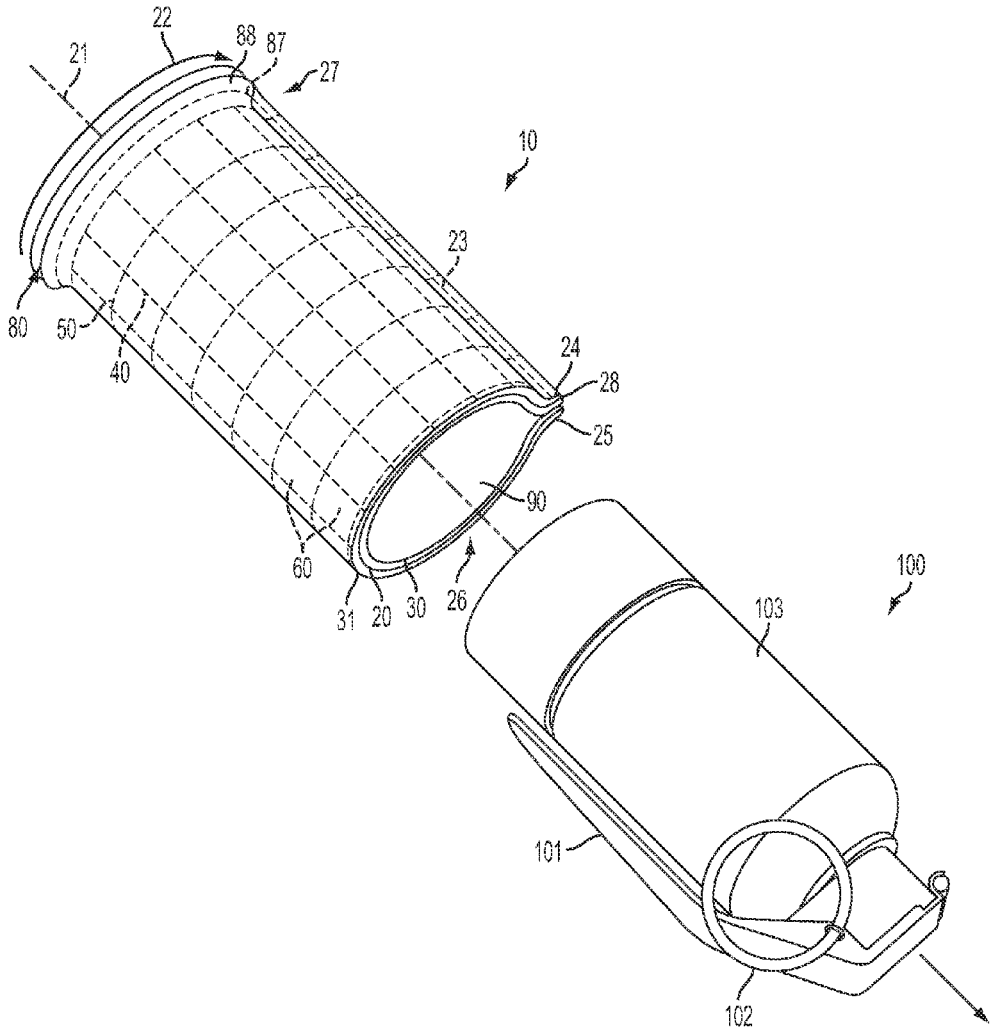
FIG. 1 is a front exploded perspective view of an illustrative flexible fragmentation sleeve and a hand deployable explosive device.

Corresponding reference characters indicate corresponding parts throughout the several views. Although the drawings represent embodiments of various features and components according to the present disclosure, the drawings are not necessarily to scale and certain features may be exaggerated in order to better illustrate and explain the present disclosure. The exemplifications set out herein illustrate embodiments of the invention, and such exemplifications are not to be construed as limiting the scope of the invention in any manner.

DETAILED DESCRIPTION OF THE DRAWINGS

For the purposes of promoting an understanding of the principles of the invention, reference will now be made to the embodiments illustrated in the drawings, which are described below. The embodiments disclosed below are not intended to be exhaustive or limit the invention to the precise form disclosed in the following detailed description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 2:
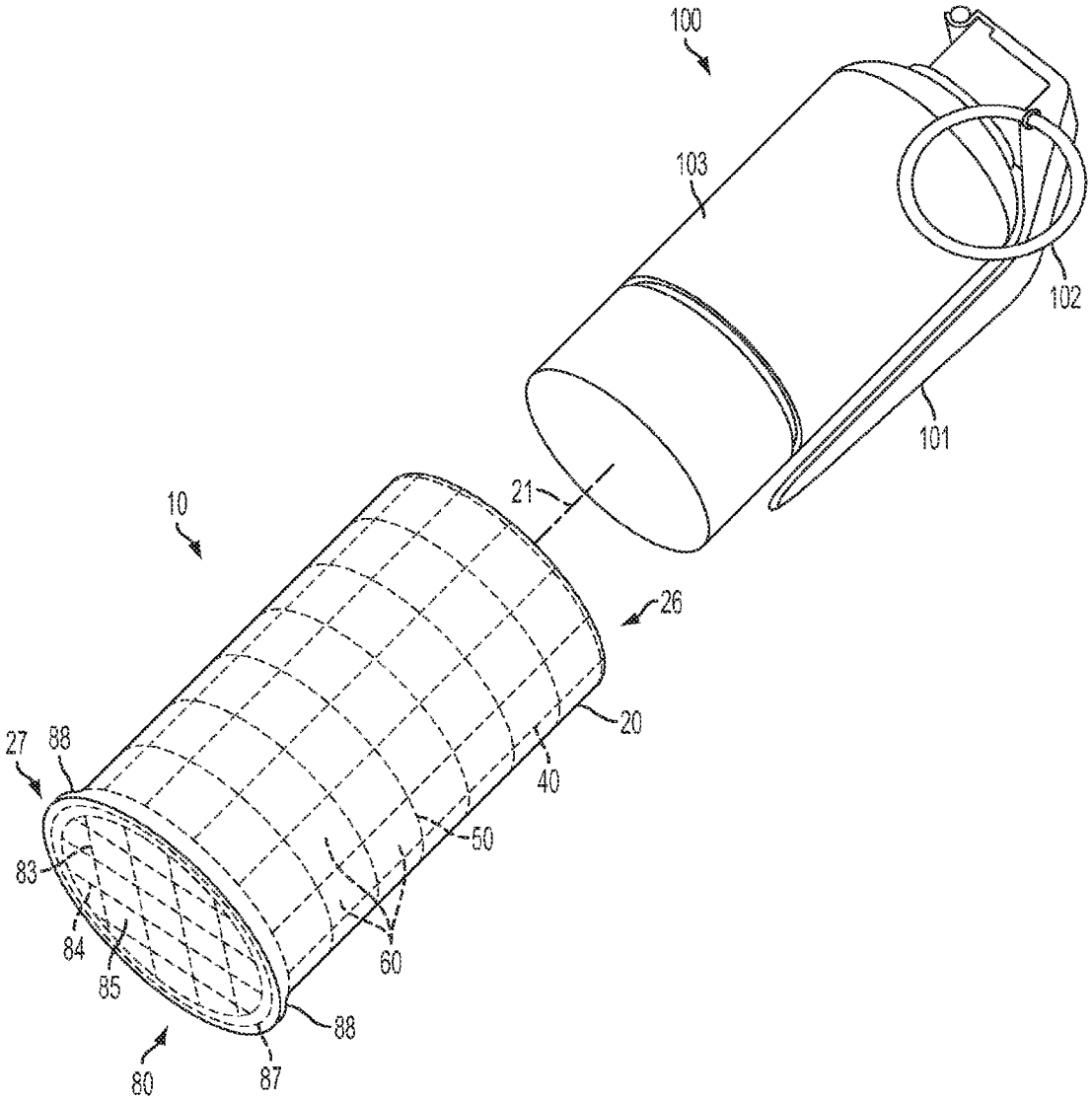
FIG. 2 is a rear exploded view of the flexible fragmentation sleeve and the hand deployable explosive device of FIG. 1.

Referring initially to FIGS. 1 and 2, an illustrative flexible fragmentation sleeve 10 and hand deployable, non-fragmenting explosive device 100 are shown. Hand deployable, or hand held, explosive device 100 may be an offensive hand grenade, often referred to as a concussion grenade. Such explosive devices may be carried in the field and are capable of being thrown or placed at a desired location by an operator without the use of a separate propellant. Hand deployable explosive devices may be used for concussion effects in enclosed areas. Additionally, hand deployable explosive devices may be used for blasting or other demolition operations.

An illustrative hand deployable, non-fragmenting explosive device is an offensive hand grenade (OHG), which may include approximately eight ounces of explosive material and weigh approximately 16 ounces. Furthermore, illustrative OHGs are often configured to be thrown up to a distance of approximately 130 feet. An illustrative OHG may have an effective radius of approximately six feet in an open area, resulting from a shock front moving at approximately 170,000 mph with an explosive loading of approximately 3,000,000 psi. An illustrative example of hand deployable explosive device 100 is the MK3A2 OHG.

Figure 5:
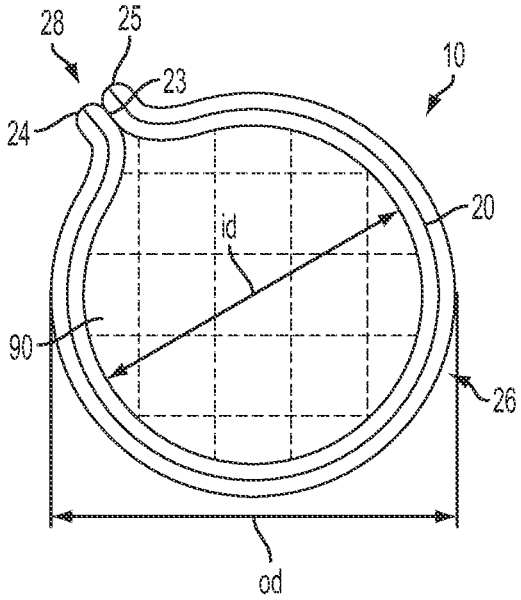
FIG. 5 is a top plan view of the flexible fragmentation sleeve of FIG. 3.

Flexible fragmentation sleeve 10, in its use or operating mode of FIGS. 1 and 2, may slidably receive explosive device 100. More particularly, sleeve 10 includes a cylindrical side wall 20 having an inner diameter (id) dimensioned to receive a cylindrical body 103 of explosive device 100 (FIG. 5). An outer diameter (od) of side wall 20 is dimensioned to accommodate the detonation means of explosive device 100 (FIG. 5). The detonation means of explosive device 100 illustratively include a safety lever 101 and a pull ring 102. When pull ring 102 is removed and safety lever 101 is released, a fuse within explosive device 100 is ignited in order to detonate explosive material within body 103 of explosive device 100 after a predetermined time period. Illustratively, inner diameter (id) of cylindrical wall 20 is approximately the same size as an outer diameter of body 103 of explosive device 100. As such, explosive device 100 is retained within cylindrical wall 20 by an interference fit. The height of cylindrical wall 20 may be determined by the level of explosive fill within body 103 of explosive device 100. In other words, cylindrical wall 20 substantially covers cylindrical body 103 but does not interfere with the detonation means of explosive device 100. Outer diameter (od) of cylindrical wall 20 slides under safety lever 101 but does not interfere with operation of explosive device 100. In this way, the size and shape of explosive device 100 may dictate the dimensions of fragmentation sleeve 10. The dimensions of sleeve 10 disclosed herein are tailored to an MK3A2 OHG; however, the dimensions of sleeve 10 may vary to accommodate different explosive devices.

Referring to FIGS. 1-5, illustrative flexible fragmentation sleeve 10 may have a length l (FIG. 4) extending axially approximately 4 inches, inner diameter (id as shown in FIG. 5) of approximately 2 inches, and outer diameter (od as shown in FIG. 5) of approximately 2.25 inches. Flexible fragmentation sleeve 10 illustratively includes cylindrical wall 20 extending between opposing ends of fragmentation sleeve 10. Cylindrical wall 20 defines a longitudinal axis 21 and a circumference 22. Circumference 22 of cylindrical wall 20 extends in a plane perpendicular to longitudinal axis 21. Flexible fragmentation sleeve 10 illustratively includes a base member 80 that assists in retaining explosive device 100 within fragmentation sleeve 10 by preventing explosive device 100 from sliding through a lower end 27 of sleeve 10. More particularly, cylindrical wall 20 of fragmentation sleeve 10 includes an open upper end 26 to receive explosive device 100, and lower end 27 coupled to base member 80. Body 103 of explosive device 100 is configured to fit tightly (i.e., interference fit) within flexible fragmentation sleeve 10. This interference fit assists in retaining hand deployable explosive device 100 within fragmentation sleeve 10. Additionally, fragmentation sleeve 10 and explosive device 100 may include other conventional couplers to further secure explosive device 100 within fragmentation sleeve 10. For example, fragmentation sleeve 10 and explosive device 100 may include cooperating pins, grooves, snap rings, hook and loop fasteners, resilient fingers, a drawstring, elastic bands, adhesive, double-sided tape, or other known fasteners.

Cylindrical wall 20 illustratively includes an inner, or first, liner 30 and an outer, or second, liner 31. Inner liner 30 includes an inner surface proximate to and facing an inner surface of outer liner 31. Inner liner 30 and outer liner 31 are illustratively comprised of a flexible fabric material that may have at least partial elasticity. For example, the fabric material may be weather-resistant woven cloth, elasticized nylon, para-aramid nylons (e.g., Kevlar), rubber, polyurethane-polyurea copolymers (e.g., Spandex), or other polymer composites. Such fabric may be used because it is lightweight and may be folded, making it easily transportable.

Inner liner 30 and outer liner 31 are shaped, or contoured, to form cylindrical wall 20. Side edges 24, 25 of inner liner 30 and outer liner 31 are illustratively contoured to extend outwardly from cylindrical wall 20 and form a securing tab 28. Side edges 24, 25 defining securing tab 28 are coupled with at least one securing member 23. Securing tab 28 may be formed when side edges 24, 25 are configured in an overlapped position and extend radially outwardly from cylindrical wall 20. Securing member 23 couples side edge 24 with side edge 25 to define securing tab 28 and assists in retaining the shape of cylindrical wall 20. Securing member 23 is illustratively shown as a line of stitched thread. However, securing member 23 may include adhesive, staples, pins, metal wire or thread, or other conventional fasteners to secure side edges 24, 25 of inner liner 30 and outer liner 31 of cylindrical wall 20. Alternatively, securing tab 28 may extend inwardly from cylindrical wall 20, such that securing tab 28 is positioned intermediate cylindrical body 103 of explosive device 100 and cylindrical wall 20. Another alternative embodiment of sleeve 10 eliminates securing tab 28 and instead, includes a seamless cylindrical wall 20.

Figure 4:
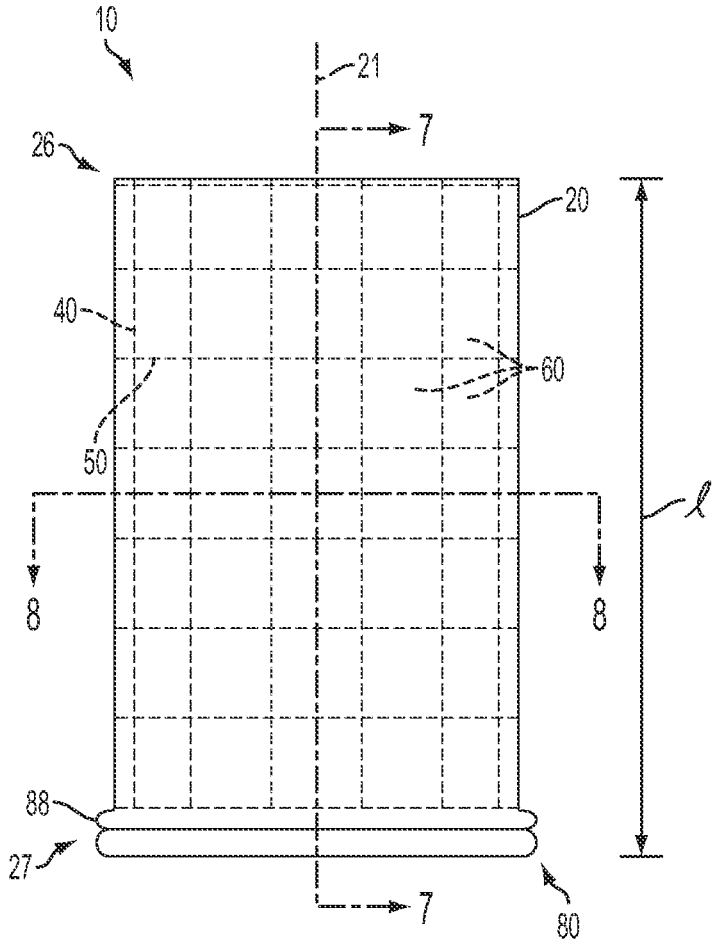
FIG. 4 is a front elevational view of the flexible fragmentation sleeve of FIG. 3.

With reference to FIG. 4, flexible fragmentation sleeve 10 illustratively includes a plurality of first coupling elements 40 and a plurality of second coupling elements 50 for securing inner liner 30 with outer liner 31. Each first coupling element 40 is illustratively spaced apart from adjacent first coupling elements 40 and extends parallel to longitudinal axis 21 of cylindrical wall 20.

The plurality of second coupling elements 50 illustratively extend circumferentially along cylindrical wall 20 and are perpendicular to the plurality of first coupling elements 40. First coupling elements 40 and second coupling elements 50 extend between inner liner 30 and outer liner 31 of cylindrical wall 20. In this way, first coupling elements 40 and second coupling elements 50 are used to couple inner liner 30 with outer liner 31. Illustratively, first coupling elements 40 and second coupling elements 50 are shown as stitching. More particularly, first coupling elements 40 and second coupling elements 50 may be comprised of a stitched thread-like material that is sufficiently durable to withstand wear during transportation and field-installation of sleeve 10. Alternatively, first coupling elements 40 and second coupling elements 50 may include adhesives, polymeric materials, staples, pins, metal wire or thread, or other conventional fasteners.

Figure 9A:
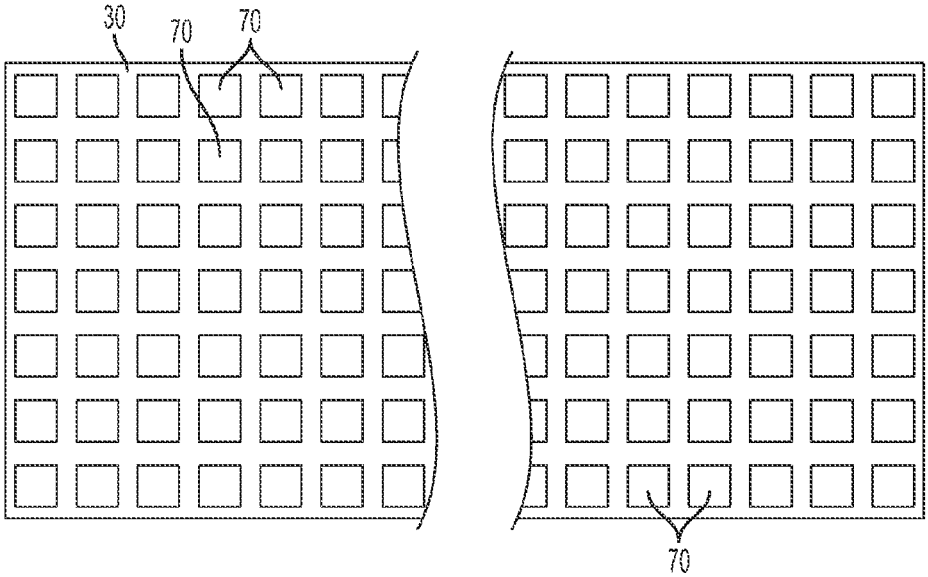
FIGS. 9A-9E show illustrative assembly steps of a side wall of the flexible fragmentation sleeve.
Figure 9B:
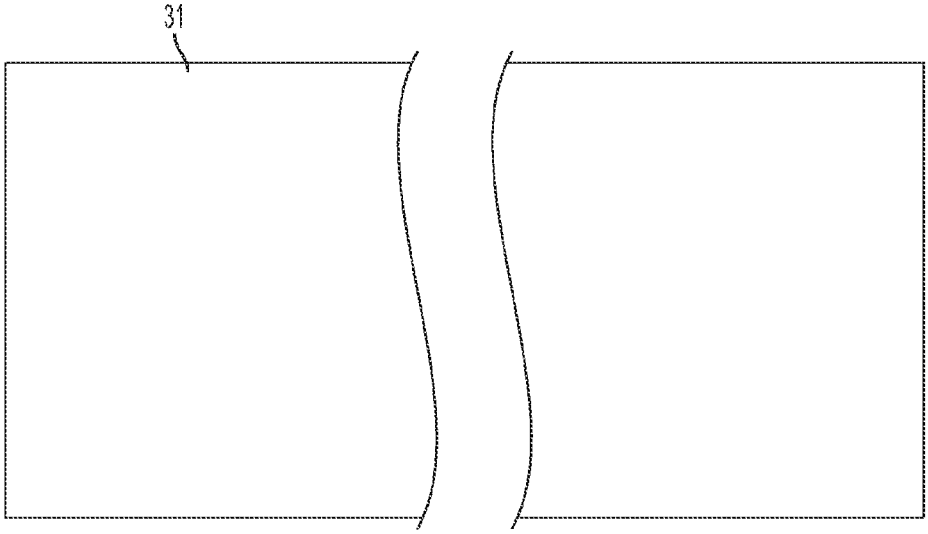
Figure 9C:
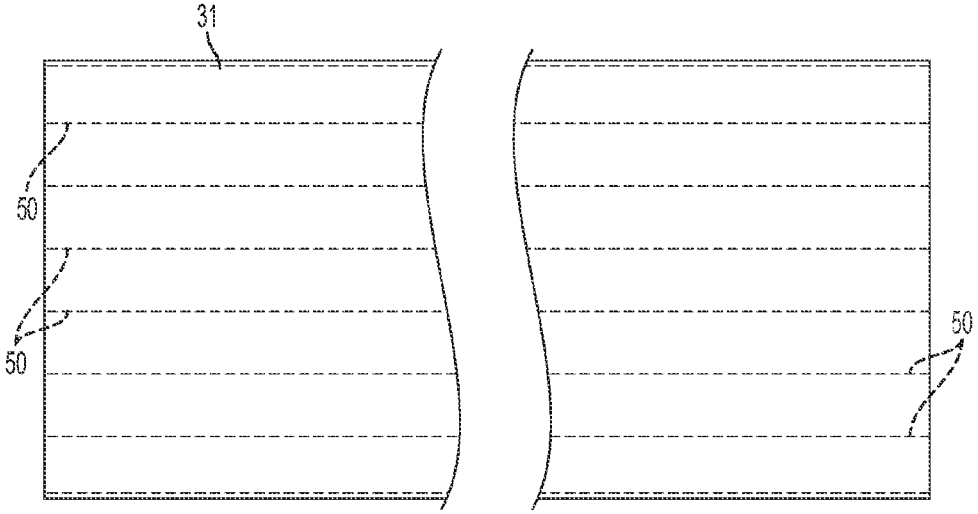
Figure 9D:
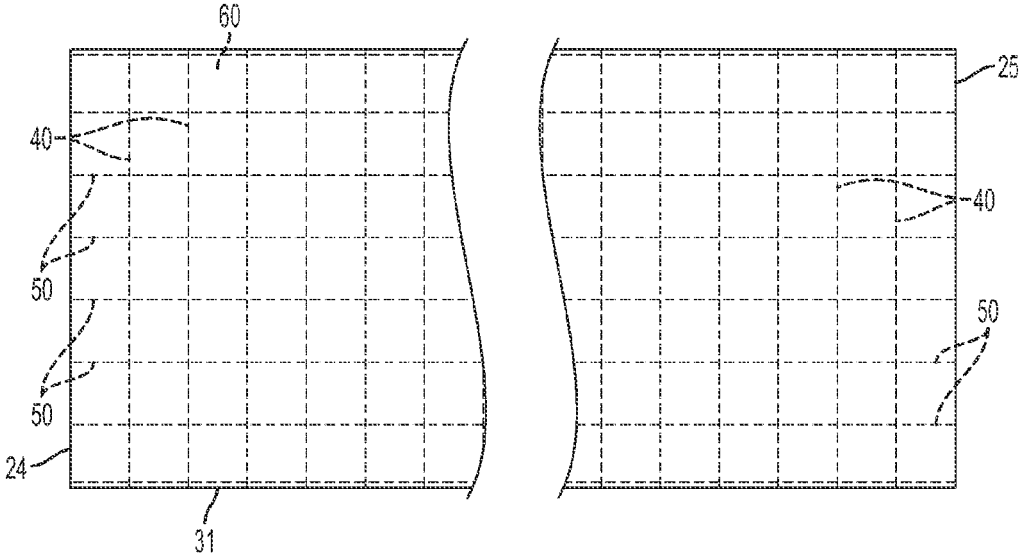

First coupling elements 40 illustratively extend longitudinally approximately four inches between upper end 26 and lower end 27 of cylindrical wall 20. Second coupling elements 50 illustratively extend about 6.25 inches around circumference 22 of cylindrical wall 20 between opposing side edges 24, 25 (FIG. 9D). The present embodiment of cylindrical wall 20 includes 21 first coupling elements 40 and 10 second coupling elements 50, however, the dimensions and number of coupling elements 40, 50 may vary, depending on the size of explosive device 100 and the desired effect of sleeve 10.

Referring further to FIG. 4, first coupling elements 40 illustratively intersect with second coupling elements 50 at right angles to define a plurality of pockets 60 within cylindrical wall 20. Each of pockets 60 is illustratively at least 0.25 inch wide and at least 0.25 inch long in order to receive at least one fragmentation member 70. Pockets 60 may be necessary to position fragmentation members 70 on cylindrical wall 20. Pockets 60 are illustratively shown as identical squares extending in a series of longitudinally extending, circumferentially spaced columns and circumferentially extending, longitudinally spaced rows. In one illustrative embodiment, cylindrical wall 20 is configured to include 231 pockets in 11 rows (rings) and 21 columns. However, the number of pockets and corresponding columns and rows may vary depending upon the desired application of fragmentation sleeve 10.

Figure 3:
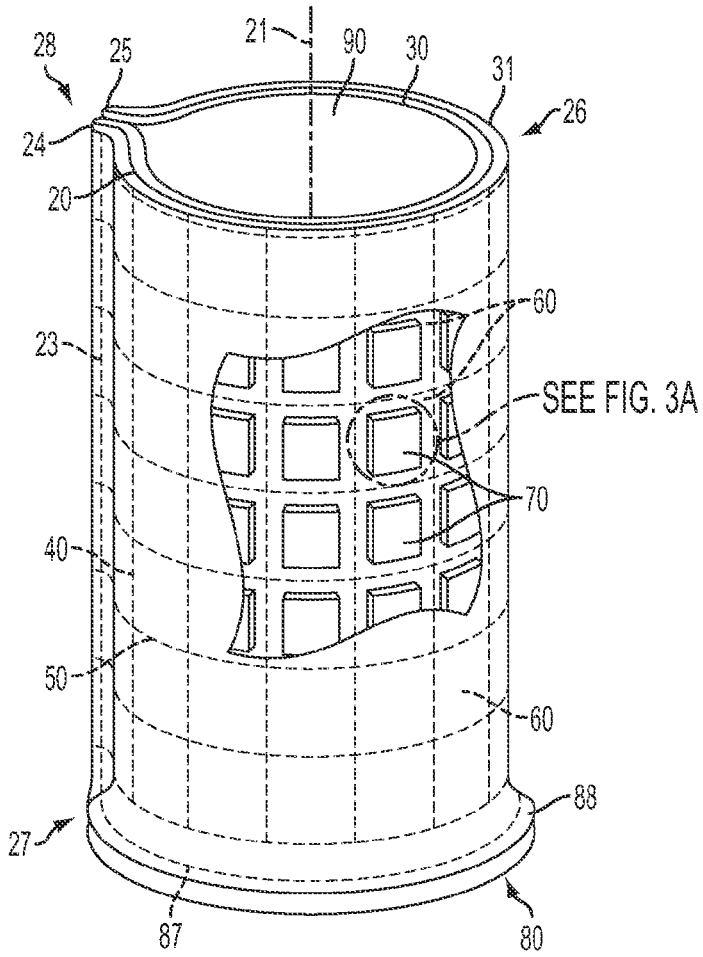
FIG. 3 is a perspective view of the flexible fragmentation sleeve including a partial cut-away showing fragmentation members.
Figure 3A:
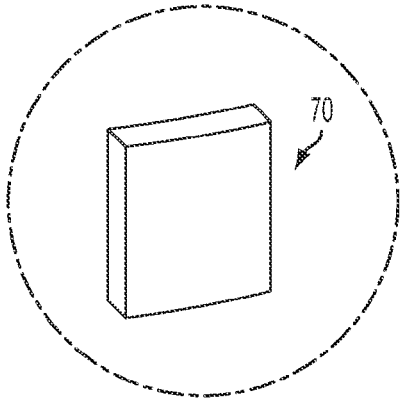
FIG. 3A is a detail view of a fragmentation member of the flexible fragmentation sleeve of FIG. 3.

Referring further to FIG. 3, pockets 60 may receive at least one of fragmentation members 70 and as such, pockets 60 illustratively support a total of 231 fragmentation members 70 in 11 rows (rings) and 21 columns. Again, the number of fragmentation members 70 may vary depending upon the desired application of fragmentation sleeve 10. Fragmentation members 70 may be comprised of metal, such as hardened tool steel. Alternatively, fragmentation members 70 may be comprised of a non-metal material. For example, fragmentation members 70 may be non-lethal fragmentation members, such as rubber balls, pepper balls, or marking agents. Specific applications of flexible fragmentation sleeve 10 may specify fragmentation members 70 be comprised of gels, particulate material, or polymers. Illustratively, fragmentation members 70 define identical squares (in cross-section) having a width of 0.25 inch and a length of 0.25 inch. Further, fragmentation members 70 may have a thickness between 0.0625 inch and 0.125 inch and a mass of 0.5 to 1.0 gram. Specific applications of fragmentation sleeve 10 dictate the size and, therefore, the number of fragmentation members 70 retained on cylindrical wall 20. For example, larger fragmentation members 70 may be more effective for penetrating a target, but the larger size of fragmentation members 70 would limit the number of fragmentation members 70 that may be accommodated on cylindrical wall 20.

Fragmentation members 70 may define a plurality of shapes, although illustratively fragmentation members 70 are square prisms, or parallelepipeds. Fragmentation members 70 having a parallelepiped configuration include flat surfaces for receiving the shock waves produced by explosive device 100. The flat surfaces of fragmentation members 70 are effective in coupling the momentum of the shock waves to accelerate fragmentation members 70 towards a target.

Figure 6:
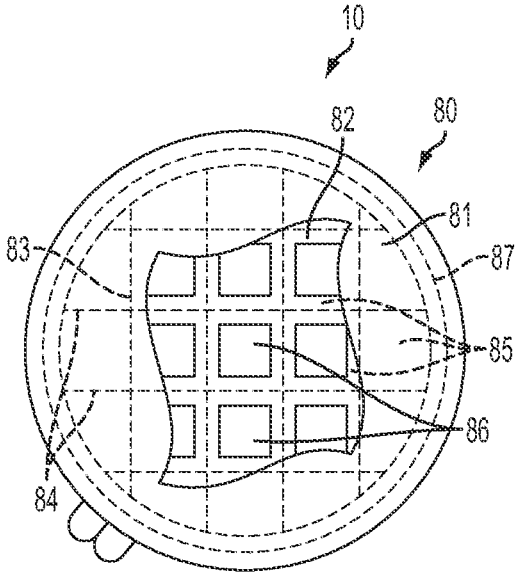
FIG. 6 is a bottom plan view of the flexible fragmentation sleeve of FIG. 3, including a partial cut away showing fragmentation members.
Figure 7:
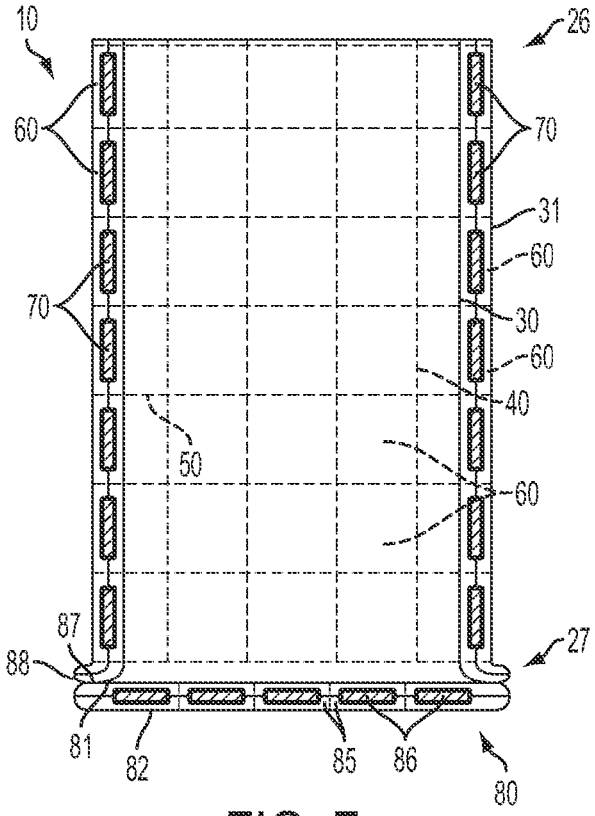
FIG. 7 is a cross-sectional view of the flexible fragmentation sleeve along line 7-7 of FIG. 4.
Figure 8:
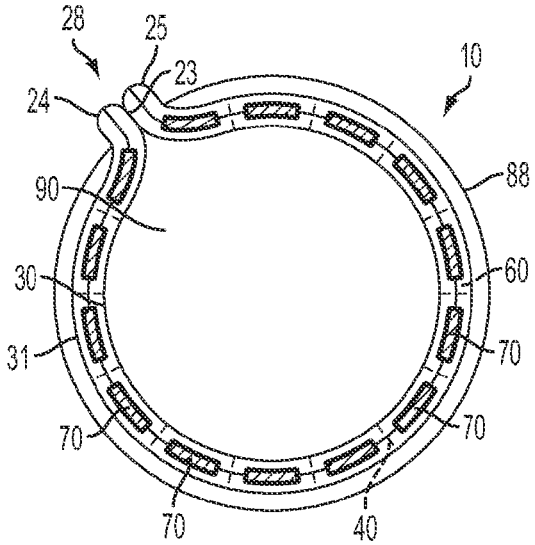
FIG. 8 is a cross-sectional view of the flexible fragmentation sleeve along line 8-8 of FIG. 4.

Referring to FIG. 6, base member 80 is coupled to lower end 27 of cylindrical wall 20 to define a closed cylinder. Illustratively, base member 80 has a circular configuration and lower end 27 of cylindrical wall 20 extends radially outwardly in a flat configuration to couple with the perimeter of base member 80. The coupling of lower end 27 with base member 80 forms a base securing tab 88. A base securing member 87 couples lower end 27 with base member 80 at base securing tab 88. Base securing member 87 may be comprised of a woven fabric material, adhesive, polymeric materials, staples, pins, metal wire or thread, or other conventional fasteners. Illustratively, base securing member 87 is shown as a line of stitched thread.

Base member 80 includes an inner liner 81 and an outer liner 82. Inner liner 81 and outer liner 82 may be comprised of weather-resistant woven cloth, elasticized nylon, para-aramid nylons (e.g., Kevlar), rubber, polyurethane-polyurea copolymers (e.g., Spandex), or other polymer composites.

Base member 80 may further include a plurality of first coupling elements 83 and a plurality of second coupling elements 84 for securing inner liner 81 with outer liner 82. First coupling elements 83 extend in a first direction. Second coupling elements 84 extend in a second direction that is perpendicular to the first direction. First coupling elements 83 and second coupling elements 84 extend between inner liner 81 and outer liner 82 of base member 80. As such, first coupling elements 83 and second coupling elements 84 may be used to couple inner liner 81 with outer liner 82. First coupling elements 83 and second coupling elements 84 may be comprised of a thread-like material. Illustratively, first coupling elements 83 and second coupling elements 84 are formed of stitched thread like material that is sufficiently durable to withstand wear during transportation and installation of fragmentation sleeve 10. Alternatively, first coupling elements 83 and second coupling elements 84 may be adhesive, polymeric materials, staples, pins, metal wire or thread, or other conventional fasteners.

First coupling elements 83 intersect second coupling elements 84 at right angles to define a plurality of pockets 85 supported within base member 80. Illustratively, pockets 85 are shown as identically-sized squares (in cross-section) having a width of at least 0.25 inch and a length of at least 0.25 inch to receive at least one fragmentation member 86. Pockets 85 illustratively support 21 fragmentation members 86, however, as with fragmentation members 70, the application and desired effect of sleeve 10 dictates the size and, therefore, the number of fragmentation members 86 retained on base member 80. Fragmentation members 86 may be identical to fragmentation members 70 and formed of metal, such as hardened tool steel.

Base member 80 is used to support hand deployable explosive device 100 as it is received within fragmentation sleeve 10. Inner surface of fragmentation sleeve 10 may define a receiving chamber 90. Receiving chamber 90 may extend from upper end 26 of fragmentation sleeve 10 to base member 80 and receive body 103 of hand deployable explosive device 100.

Referring to FIGS. 9A-9E, cylindrical wall 20 of flexible fragmentation sleeve 10 may be manufactured by initially providing first liner 30 of fabric in a planar configuration to support fragmentation members 70 on the inner surface of first liner 30. Fragmentation members 70 are in spaced relation to each adjacent fragmentation member. Second fabric liner 31 is placed in a planar configuration over first liner 30 and fragmentation members 70. The inner surface of second liner 31 faces the inner surface of first liner 30. As such, fragmentation members 70 are positioned intermediate the inner surface of first liner 30 and the inner surface of second liner 31. First coupling elements 40 are provided to secure first liner 30 to second liner 31. Each first coupling element 40 is spaced apart from adjacent first coupling elements 40. Additionally, each first coupling element 40 extends parallel to adjacent first coupling elements 40. Second coupling elements 50 also are provided to secure first liner 30 to second liner 31. Each of second coupling elements 50 is spaced apart from adjacent second coupling elements 50. Additionally, each second coupling element 50 extends parallel to adjacent second coupling elements 50 and perpendicular to first coupling elements 40. The intersection between first coupling elements 40 and second coupling elements 50 defines the plurality of pockets 60. As such, pockets 60 each include at least one of fragmentation members 70.

Referring to FIGS. 10A-10D, the method of manufacturing base member 80 is similar to the method described for manufacturing cylindrical wall 20. First liner 81 is provided and may be comprised of fabric. First liner 81 may support fragmentation members 86 on the inner surface of first liner 81. Fragmentation members 86 are in spaced relation to each adjacent fragmentation member. Second liner 82 is placed over first liner 81 and fragmentation members 86. The inner surface of second liner 82 faces the inner surface of first liner 81. As such, fragmentation members 86 are positioned intermediate the inner surface of first liner 81 and the inner surface of second liner 82. First coupling elements 83 are provided to secure first liner 81 to second liner 82. Each first coupling element 83 is spaced apart from adjacent first coupling elements 83. Additionally, each first coupling element 83 extends parallel to adjacent first coupling elements 83. Second coupling elements 84 also are provided to secure first liner 81 to second liner 82. Each of second coupling elements 84 is spaced apart from adjacent second coupling elements 84. Additionally, each second coupling element 84 extends parallel to adjacent second coupling elements 84 and perpendicular to first coupling elements 83. The intersection between first coupling elements 83 and second coupling elements 84 defines plurality of pockets 85. Pockets 85 include at least one of fragmentation members 86.

Alternatively, flexible fragmentation sleeve 10 may be manufactured by forming an indefinitely long sheet including first liner 30, fragmentation members 70, second liner 31, first coupling elements 40, and second coupling elements 50. The sheet may be cut to a desired length for flexible fragmentation sleeve 10. Further, the desired size and shape for base member 80 also may be cut from the sheet.

Figure 9E:
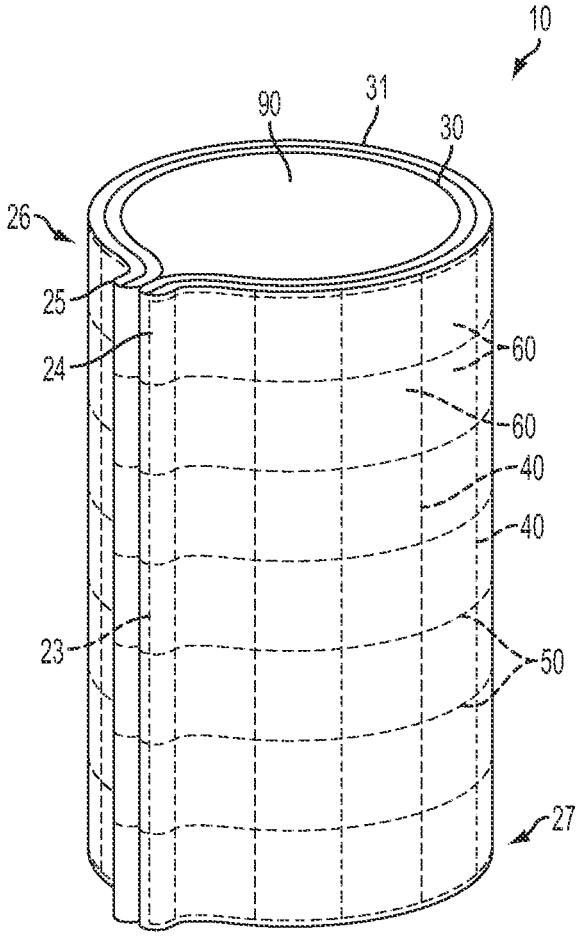
Figure 10A:
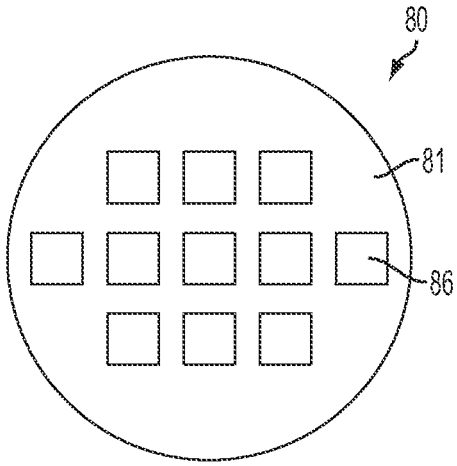
FIGS. 10A-10D show illustrative assembly steps of a base member of the flexible fragmentation sleeve.
Figure 10B:
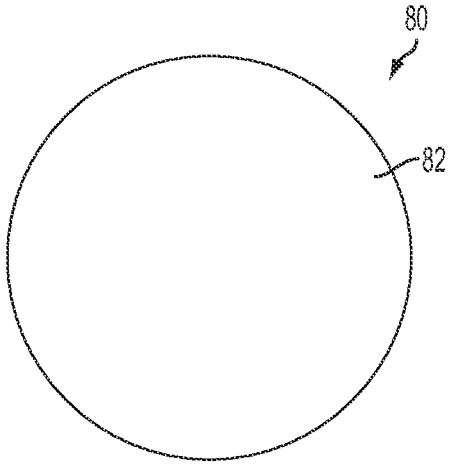
Figure 10C:
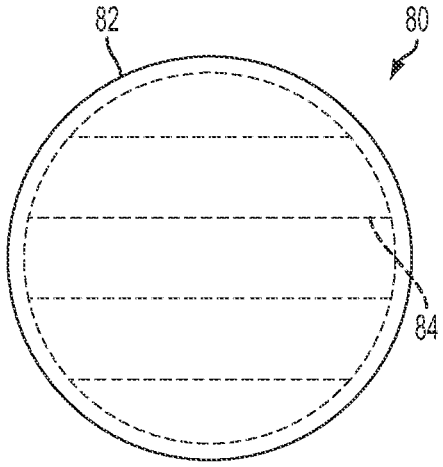
Figure 10D:
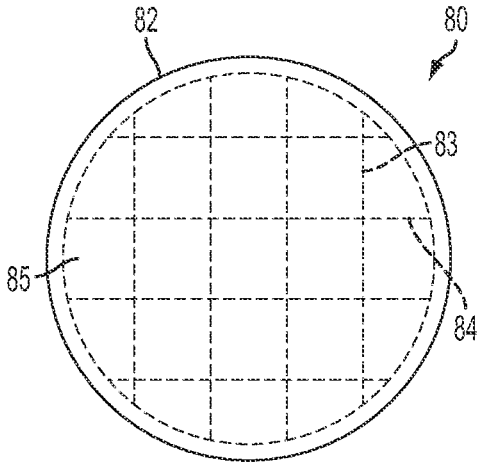

The planar assembly of FIG. 9D is illustratively formed into cylindrical wall 20, as disclosed in FIG. 9E. Side edges 24, 25 of inner liner 30 and outer liner 31 are brought together and overlapped to form a contoured, or rounded, configuration defining cylindrical wall 20. Securing member 23 illustratively couples side edge 24 with side edge 25 to form securing tab 28.

Base member 80 is coupled to lower end 27 of cylindrical wall 20 with base securing member 87, or alternatively, with conventional couplers. Lower end 27 is extended in a flat configuration and is positioned against the rounded perimeter of base member 80. Overlapping lower end 27 and base member 80 are coupled with base securing member 87 to form base securing tab 88.

Figure 11:
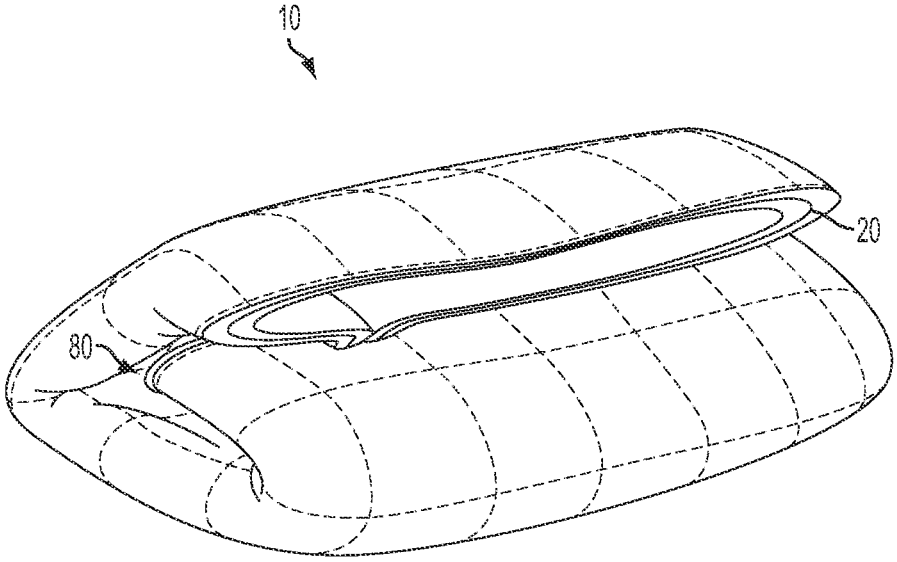
FIG. 11 is a perspective view of the flexible fragmentation sleeve of FIG. 1 in a storage mode of operation.

Referring to FIG. 11, in use, flexible fragmentation sleeve 10 may be combined with hand deployable, non-fragmenting explosive device 100. Flexible fragmentation sleeve 10 may be provided in a stowed, or storage, mode of operation where cylindrical wall 20 is collapsed and/or folded onto itself. Illustratively, upper end 26 of fragmentation sleeve 10 is folded against opposing sides and lower end 27 of fragmentation sleeve 10 is folded against opposing sides, thereby giving cylindrical wall 20 a generally flat configuration. Likewise, base member 80 may be folded against opposing sides to form a generally flat configuration. The stowed mode of operation may further include folding cylindrical wall 20, in its collapsed configuration, over and around collapsed base member 80.

With reference to FIG. 1, a flexible side wall of cylindrical wall 20 may be extended, or unfolded, to increase the volume of cylindrical wall 20, thereby defining an operating, or use, mode. With cylindrical wall 20 fully extended, receiving chamber 90 is illustratively defined. Hand held explosive device 100 is slidably received within receiving chamber 90. More particularly, body 103 of explosive device 100 is received within receiving chamber 90, whereas, safety lever 101 and pull ring 102 are positioned outside of receiving chamber 90 and cylindrical wall 20.

Hand deployable explosive device 100 may be detonated when received within receiving chamber 90. Additionally, when explosive device 100 is received within receiving chamber 90, the assembly of fragmentation sleeve 10 and explosive device 100 may be released and propelled in a direction away from the operator; or alternatively, the assembly may be placed by the operator at a desired location. Upon detonation of explosive device 100, an explosive force propagates shock waves into the fragmentation members 70 within cylindrical wall 20 of sleeve 10, such that cylindrical wall 20 may separate or tear between first coupling elements 40 and second coupling elements 50 as the fragmentation members 70 seek a path of least resistance as they are propelled by the shock waves. As such, fragmentation members 70 may be propelled radially outwardly in a controlled manner. Similarly, fragmentation members 86 may project axially outwardly from base member 80 after shock waves cause the fragmentation members 86 to separate base member 80 intermediate first and second coupling elements 83 and 84. The resulting blast pattern of fragmentation members 70 and 86 from explosive device 100 may correspond to the shape of sleeve 10. Flexible fragmentation sleeve 10 may be easy to transport, flexible, and substantially noiseless. Furthermore, because flexible fragmentation sleeve 10 may be removably coupled to hand deployable explosive device 100, fragmentation sleeve 10 is adaptable to differing needs in the field.

While this invention has been described as having an exemplary design, the present invention may be further modified within the spirit and scope of this disclosure. This application is therefore intended to cover any variations, uses, or adaptations of the invention using its general principles. Further, this application is intended to cover such departures from the present disclosure as come within known or customary practices in the art to which this invention pertains.

What is claimed is:

1. A hand deployable flexible fragmentation sleeve for use with a non-fragmenting explosive device comprising:

a flexible first liner configured to convert from a storage mode to an operating mode, the flexible first liner being folded onto itself in the storage mode, and the flexible first liner defining a cylindrical wall forming a receiving chamber for the explosive device in the operating mode;

a plurality of fragmentation members supported by the liner;

a second flexible liner;

a first set of coupling elements coupling the first flexible liner with the second flexible liner;

a second set of coupling elements extending perpendicular to the first set of coupling elements, and coupling the first flexible liner with the second flexible liner;

a plurality of pockets defined intermediate the first flexible liner and the second flexible liner, and intermediate the first set of coupling elements and the second set of coupling elements; and at least one fragmentation member received within each pocket.

2. The flexible fragmentation sleeve of claim 1, wherein the fragmentation members are comprised of metal, each fragmentation member having a mass of at least 0.5 gram.

3. The flexible fragmentation sleeve of claim 2, wherein the fragmentation members each include a plurality of side walls, the side walls each having a length of at least 0.250 inches.

4. The flexible fragmentation sleeve of claim 3, wherein the fragmentation members each have a thickness of at least 0.0625 inches.

5. The flexible fragmentation sleeve of claim 1, wherein the flexible liner is comprised of fabric, the fabric being resistant to weather and temperature fluctuations.

6. The flexible fragmentation sleeve of claim 1, wherein the first set of coupling elements and the second set of coupling elements are comprised of stitches of thread.

7. The flexible fragmentation sleeve of claim 1, wherein the operating mode defines a closed cylindrical wall having an inner diameter of at least 2 inches and a length of at least 4 inches.

8. The flexible fragmentation sleeve of claim 7, wherein an explosive device is slidably received within the cylindrical wall.

9. A hand deployable flexible fragmentation sleeve for use with a non-fragmenting explosive device comprising:

a flexible first liner configured to convert from a storage mode to an operating mode, the flexible first liner being folded onto itself in the storage mode, and the flexible first liner defining a cylindrical wall forming a receiving chamber for the explosive device in the operating mode;

a plurality of fragmentation members supported by the liner; and a base member, the base member being coupled to an end of the first flexible liner.

* * * * *